US005678140A

United States Patent [19]

Fuei et al.

[11] Patent Number: 5,678,140

[45] Date of Patent: Oct. 14, 1997

[54] RECONDITIONING METHOD FOR CHARGING ROLLER

[75] Inventors: Naoki Fuei, Kawaguchi; Hiroshi Inoue, Kamakura, both of Japan

[73] Assignee: Canon Kabushiki Kaisha, Tokyo, Japan

[21] Appl. No.: 568,642

[22] Filed: Dec. 7, 1995

[30] Foreign Application Priority Data

Dec. 7, 1994 [JP] Japan ..... 6-303671

[51] Int. Cl.[6] ..... G03G 15/00

[52] U.S. Cl. ..... 399/109

[58] Field of Search ..... 399/109; 29/895.1; 156/94

[56] References Cited

U.S. PATENT DOCUMENTS 5,381,213 1/1995 Michlin ..... 399/109

*Primary Examiner*—William J. Royer

*Attorney, Agent, or Firm*—Fitzpatrick, Cella, Harper & Scinto

[57] ABSTRACT

A reconditioning method for a used charging roller, wherein the charging roller having a core member and a coating layer thereon, the coating layer including an electroconductive layer and a first resistance layer covering a peripheral surface layer and end surface layer. The method includes removing an end portion of the coating layer and coating the removed end portion with a second resistance layer.

12 Claims, 4 Drawing Sheets

FIG. 5A
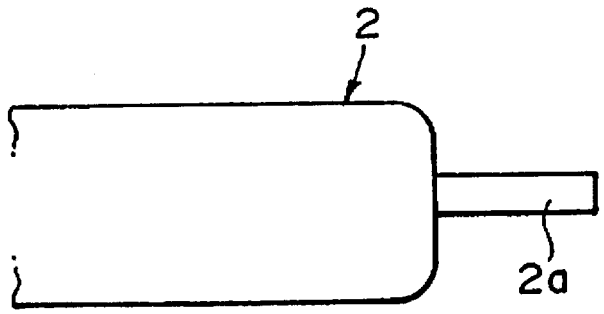
FIG. 5B
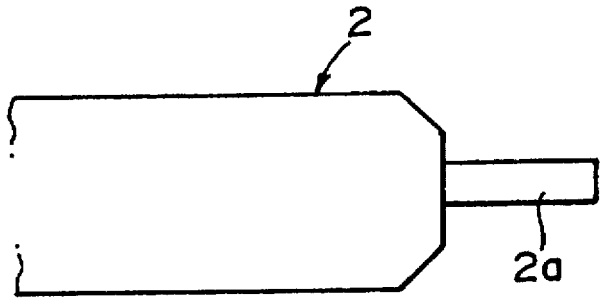
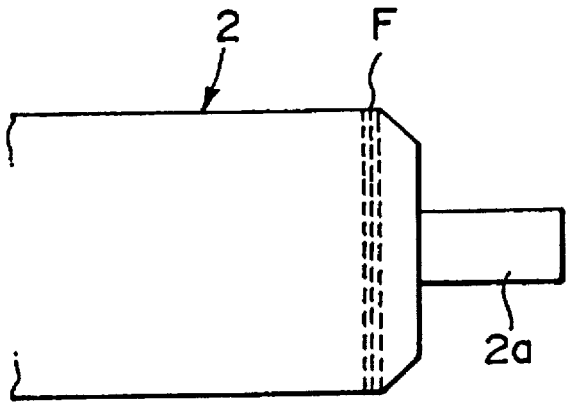
FIG. 6

RECONDITIONING METHOD FOR CHARGING ROLLER

FIELD OF THE INVENTION AND RELATED ART

The present invention relates to a reconditioning, refreshing or recovery method for a charging roller employed in an image forming apparatus or the like of an electrophotographic type.

It is known that an image forming apparatus such as an electrophotographic apparatus usually employs a charging roller as a member for charging a photosensitive member.

It is also known that the charging roller comprises a metallic core member, an electrically conductive elastic layer supported on the metallic core member, and an electrically resistive layer disposed on the electrically conductive elastic layer. The charging roller with the above structure has been expected to be reusable even after the service life of a process cartridge or an image forming apparatus expires.

However, when using a used charging roller recycled from a process cartridge or an image forming apparatus, the service life of which has expired, the following problems must be dealt with:

The resistive layer of the charging roller frequently becomes thinner at the longitudinal ends, deteriorating the withstand voltage of the charging roller, which is dependent on the thickness of the resistive layer, at the longitudinal ends.

The charging roller chamfered at the longitudinal ends is liable to crack through usage. When a charging roller with cracks is employed, an excessive amount of current flows through electrically conductive paths, which are established between the metallic core of the charging roller and the shaved portion of the photosensitive member. As a result, the charging roller is liable to be subjected to dielectric breakdown.

SUMMARY OF THE INVENTION

Accordingly, a primary object of the present invention is to provide a method for reconditioning a highly durable charging roller.

Another object of the present invention is to provide a charging roller reconditioning method capable of rendering the longitudinal ends of the charging roller immune to dielectric breakdown.

Another object of the present invention is to provide a charging roller reconditioning method capable of preventing an excessive amount of current from flowing through the longitudinal ends of the reconditioned charging roller.

These and other objects, features and advantages of the present invention will become more apparent upon a consideration of the following description of the preferred embodiments of the present invention, taken in conjunction with the accompanying drawings.

BRIEF DESCRIPTION OF THE DRAWINGS

FIG. 5(*a*) depicts one of the configurations of the longitudinal end of a charging roller, and FIG. 5(*b*) depicts another configuration of the same.

FIG. 6 is a schematic view of the worn longitudinal end of a used charging roller, the service life of which is considered to have expired.

DESCRIPTION OF THE PREFERRED EMBODIMENTS

Hereinafter, the preferred embodiments of the present invention will be described with reference to the drawings.

Figure 3:
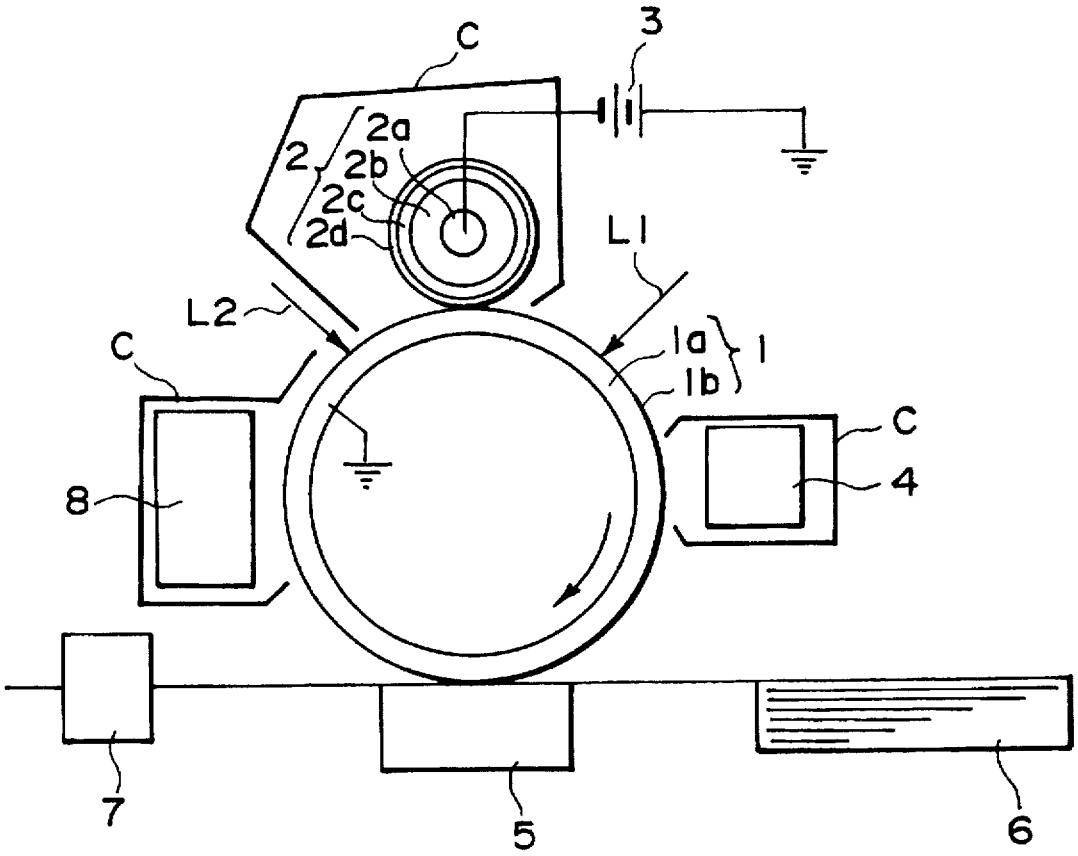
FIG. 3 is a schematic structural view of the essential portions of an electrophotographic apparatus (laser beam printer) employing a charging roller.

FIG. 3 shows the general structure of an electrophotographic apparatus (laser beam printer) employing a charging roller as a primary charging means.

In the drawing, a reference numeral 1 designates a rotary drum type electrophotographic photosensitive member (hereinafter, photosensitive drum), which is the member to be charged. This photosensitive drum 1 comprises an electrically conductive drum base 1*a* of aluminum or the like, and a photosensitive layer 1*b*. The drum base 1*a* is formed of aluminum or the like, and the photosensitive layer 1*b* is formed on the peripheral surface of the drum base 1*a*. The photosensitive drum 1 is rotatively driven at a predetermined peripheral velocity (process speed) in the direction indicated by an arrow mark (clockwise direction).

A reference numeral 2 designates a charging roller, which is a contact type charge member. It is placed in contact with the photosensitive drum 1, with a predetermined contact pressure, in parallel to the generatrix of the photosensitive drum surface, being thereby rendered to follow the rotation of photosensitive drum 1.

The photosensitive drum 1 uniformly charged by the charging roller 2 is exposed to an optical image, which is formed by a scanning laser beam projected from a laser beam scanner in response to image data. As a result, an electrostatic latent image is formed on the photosensitive drum 1. The electrostatic latent image is developed into a toner image, with the toner in a development device 4. Then, the toner image is transferred by a transfer charger 5, from the photosensitive drum 1 onto a transfer material delivered from a cassette 6. After the transfer, the toner image is fixed to the transfer material by a fixing device 7, and then, the transfer material with the fixed toner image is discharged from the image forming apparatus. On the other hand, the toner remaining on the photosensitive drum 1 after the transfer is removed by a cleaner 8, and then, the photosensitive drum 1 is exposed by the aforementioned exposing device to remove the residual charge. The photosensitive drum 1 having been cleared of the residual charge is charged again by the charging roller 2 to be used for the next image formation.

The photosensitive drum 1, the charging roller 2, the development device 4, and the cleaner 8 are integrally mounted in a process cartridge C, which is removably mountable in the main assembly of an image forming apparatus.

Figure 4:
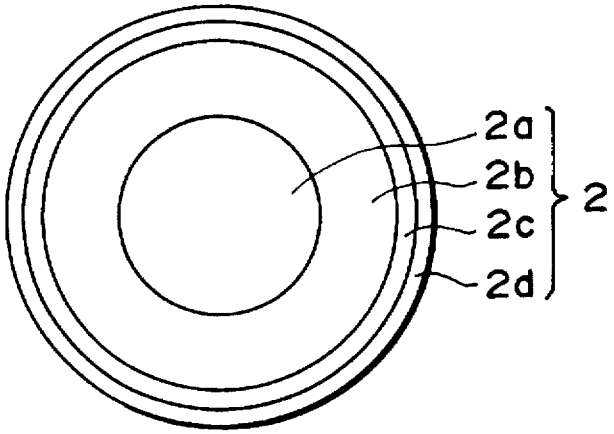
FIG. 4 is a schematic section of a charging roller, and depicts the layers of the charging roller.

FIG. 4 schematically depicts the structural layers of the aforementioned charging roller 2. The charging roller 2 comprises: an electrically conductive metallic core 2*a*, to which voltage is applied; an electrically conductive elastic layer 2*b* formed on the peripheral surface of the metallic core 2*a*; and a resistance control layer 2*c* formed on the elastic layer 2*b*. The electrically conductive elastic layer 2*b* is a layer for giving elasticity and electrical conductivity to the charging roller 2, and the resistance control layer 2c is a layer for controlling the resistance value of the charging roller 2. It is preferable, though not necessary, that a surface protection layer 2d is formed on the external surface of the resistance control layer 2c. The volumetric resistivity of the resistance layer 2c is larger than that of the electrically conductive elastic layer 2b. In other words, the charging roller 2 of this embodiment comprises the metallic core 2a, and three coat layers: the elastic layer 2b, the resistance layer 2c, and the protection layer 2d.

In FIG. 3, a reference numeral 3 designates a power source for applying voltage to the charging roller 2. As a predetermined voltage is applied from this power source 3 to the electrically conductive metallic core 2a of the charging roller 2, the surface of the photosensitive drum 1, which is being rotated, is charged to a predetermined potential. The voltage applied to the charging roller 2 may be a DC voltage alone, or a voltage comprising a DC component and an oscillating component such as an AC voltage. From the standpoint of uniform charge, it is advantageous to apply an oscillating voltage superposed on a DC voltage. The power source 3 is placed in the main assembly of the image forming apparatus.

As for the end configuration of the charging roller 2, the longitudinal ends of the charge member 2 may be rounded (R-shaped, or arc-shaped) as shown in FIG. 5(a), or may be chamfered at 45° (C-surfaced) as shown in FIG. 5(b). In either case, the aforementioned structural layers (electrically conductive elastic layer 2b, resistance control layer 2c, and surface protection layer 2d) are extended to the end, or the end surface, of the charging roller 2 as shown in FIG. 4.

The electrically conductive metallic core 2a is constituted of a round rod of electrically conductive metallic material such as iron, copper, stainless steel, aluminum, nickel, or the like. Such a rod may be chemically plated with nickel or the like to prevent the metallic rod surface from rusting, or to render it scratch resistant, as long as plating does not deprive the charging roller of electrical conductivity.

The electrically conductive elastic layer 2b of the charging roller 2 provides the charging roller 2 with the proper amount of electrical conductivity, and also the proper amount of elasticity which reliably keeps the charging roller 2 in contact with the photosensitive drum 1. As a result, the photosensitive drum 1 can be uniformly charged.

In order to further improve the uniformity of the contact between the charging roller 2 and photosensitive drum 1, the electrically conductive layer 2b may be ground in such a manner that the external diameter of the charging roller 2 is gradually reduced from the center toward the longitudinal ends, giving the charging roller 2 a so-called crown shape. The charging roller 2 is pressed on the photosensitive drum 1 by applying a predetermined amount of pressure, which is generated by a pressing member such as a spring or the like, to both longitudinal ends of the metallic core 2; therefore, the pressure applied to the charging roller 2 is smallest at the center of the charging roller, and is gradually increases toward the ends. Consequently, the straightness of the charging roller 2 being pressed on the photosensitive drum 1 is liable to become insufficient, creating density aberration on the image portion correspondent to the central portion of the charging roller 2. In order to prevent the occurrence of this density aberration, it is preferable to give the charging roller 2 a crown-like configuration.

The electrical conductivity of the electrically conductive elastic layer 2b is adjusted by adding an electrically conductive agent such as carbon black or the like to elastic material such as rubber. The elasticity thereof is adjusted by adding process oil, plasticizer, or the like. Specific elastic material usable for the electrically conductive elastic layer 2b are natural rubber, synthetic rubber, and thermoplastic elastomer. Examples of the synthetic rubber are ethylene-propylene rubber (EPDM), styrene-butadiene rubber (SBR), isoprene rubber (IR), butadiene rubber (BR), acrylonitrile-butadiene rubber (NBR), chloroprene rubber (CR), and the like. Examples of the thermoplastic elastomer are polyolefine elastomer, polyamide elastomar, polystyrene elastomer, polyester elastomer, silicon elastomer, and the like. These elastic materials may be employed in the chemically or physically foamed state.

The resistance control layer 2c is provided for controlling the resistance value of the charging roller 2. For specific material for the resistance control layer 2c, it is possible to list synthetic resins such as polyamide resin, polyurethane resin, fluororesin, silicon resin, and the like, and synthetic rubbers such as hydrine rubber, urethane rubber, silicon rubber, chloroprene rubber, and the like. It should be noted here that the electrically conductive agent such as electrically conductive carbon black, electrically conductive titanium oxide, electrically conductive tin oxide, electrically conductive zinc oxide, metallic salts of alkali metal, ammonium salts, and the like, may be dispersed in the resistance control layer 2c to adjust the resistance.

The surface protection layer 2d is provided for preventing the plasticizer or oil, which is contained in the resistance control layer 2c or electrically conductive elastic layer 2b, from bleeding out of the surface of the charging roller 2. For specific materials for the surface protection layer 2d, synthetic resins and synthetic rubbers may be listed. The examples of the synthetic resin are polyamide resin, polyurethane resin, fluororesin, silicon resin, and the like, and the examples of the synthetic rubber are hydrine rubber, urethane rubber, chloroprene rubber, and the like. It should also be noted here that electrically conductive agent such as electrically conductive carbon black, electrically conductive titanium oxide, electrically conductive tin oxide, electrically conductive zinc oxide, metallic salts of alkali metals, ammonium salts, or the like may be dispersed in the surface protection layer 2d to adjust the resistance.

As stated above, it is preferable that the longitudinal end of the charging roller 2 is rounded (R-shaped) or chamfered (C-shaped). This is because, when a charging roller, which comprises an electrically conductive elastic layer 2b with low electrical resistance, and which is rendered simply flat at the end portion of the peripheral surface, is employed in combination with a photosensitive drum 1 with a pin hole, a current path is established through the pin hole and electrically conductive elastic layer 2b, reducing the applied voltage. Therefore, it is preferable that the resistance control layer 2c or surface protection layer 2d are extended enough to cover the longitudinal end surfaces of the charging roller 2. Thus, the longitudinal end portions of the charging roller 2 are rounded or chamfered, so that even the end surfaces can be coated with the resistive layer 2c and protection layer 2d. Further, coating of the end surfaces affords more latitude in the resistance adjustment for the electrically conductive elastic layer 2b.

However, when a conventional charging roller employed in a process cartridge or the like is reused after reconditioning, the following problems occur.

In the case of a charging roller chamfered the longitudinal ends of its coat layers, cracks sometimes occur at the chamfers, through usage, and when the charging roller with cracked ends is reused without reconditioning, in combination with a photosensitive drum having been shaved through usage, an electrically conductive path is established between the charging roller and the metallic core of the photosensitive member, through the shaved portion of the photosensitive member. Consequently, a large amount of current is liable to flow through the established electrical path, causing the dielectric breakdown of the charging roller 2.

Further, when the longitudinal ends of the charging roller's coat layers are chamfered, the resistance control layer 2*c* and surface protection layer 2*d* exposed at the chamfered ends become thinner. Generally speaking, withstand voltage is dependent on film thickness. In other words, the thinner the film is, the lower the withstand voltage is; therefore, the withstand voltage of the charging roller 2 is lower at the chamfered portion.

Also in the case of the charging roller with the chamfered ends, the withstand voltage of the charging roller 2 is liable to deteriorate through usage, at the chamfers where the resistance control layer 2*c* or surface protection layer 2*d* is thinner. It is suspected that this deterioration of the withstand voltage occurs due to the material deterioration caused by the current, and also due to the internal cracks generated by the high pressure applied to the end portions of the charging roller 2. Further, it is known that the end portions of the peripheral surface of the charging roller 2 (portion designated by a reference F in FIG. 6) wear out, or are shaved away, through usage, due to the pressure applied thereto.

When a used charging roller 2 is assembled (recycled) into a process cartridge, it is liable to become leaky through usage (dielectric breakdown occurs). In particular, when it is used in combination with a photosensitive drum 1 with pin holes, or a shaved photosensitive drum 1, occurrence of current leakage is more probable.

Figure 1:
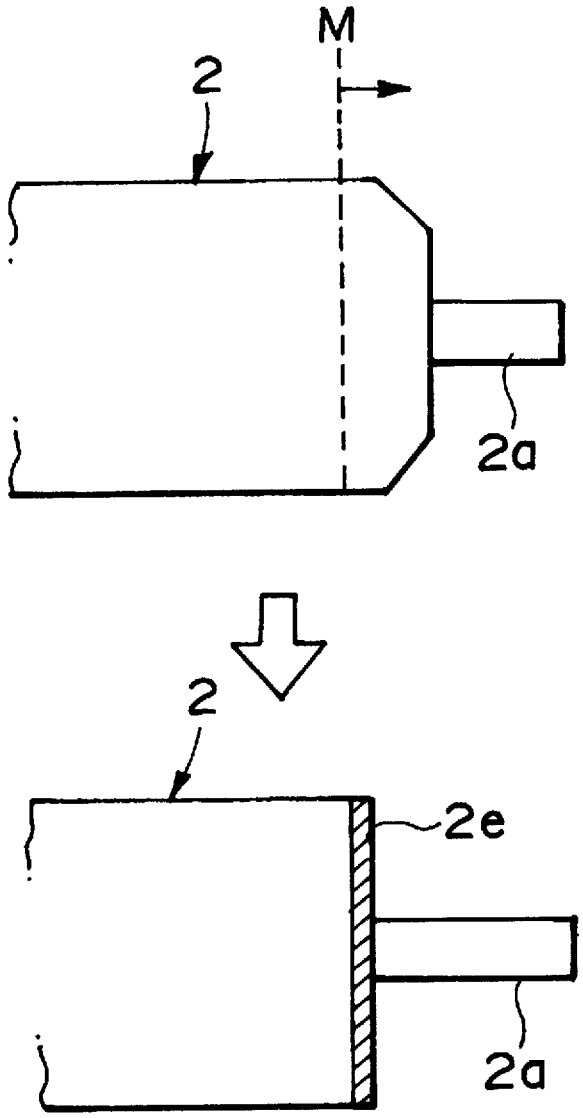
FIG. 1 is a schematic view of one of the longitudinal ends of a charging roller, and illustrates a charging roller reconditioning method in accordance with the present invention.
Figure 2:
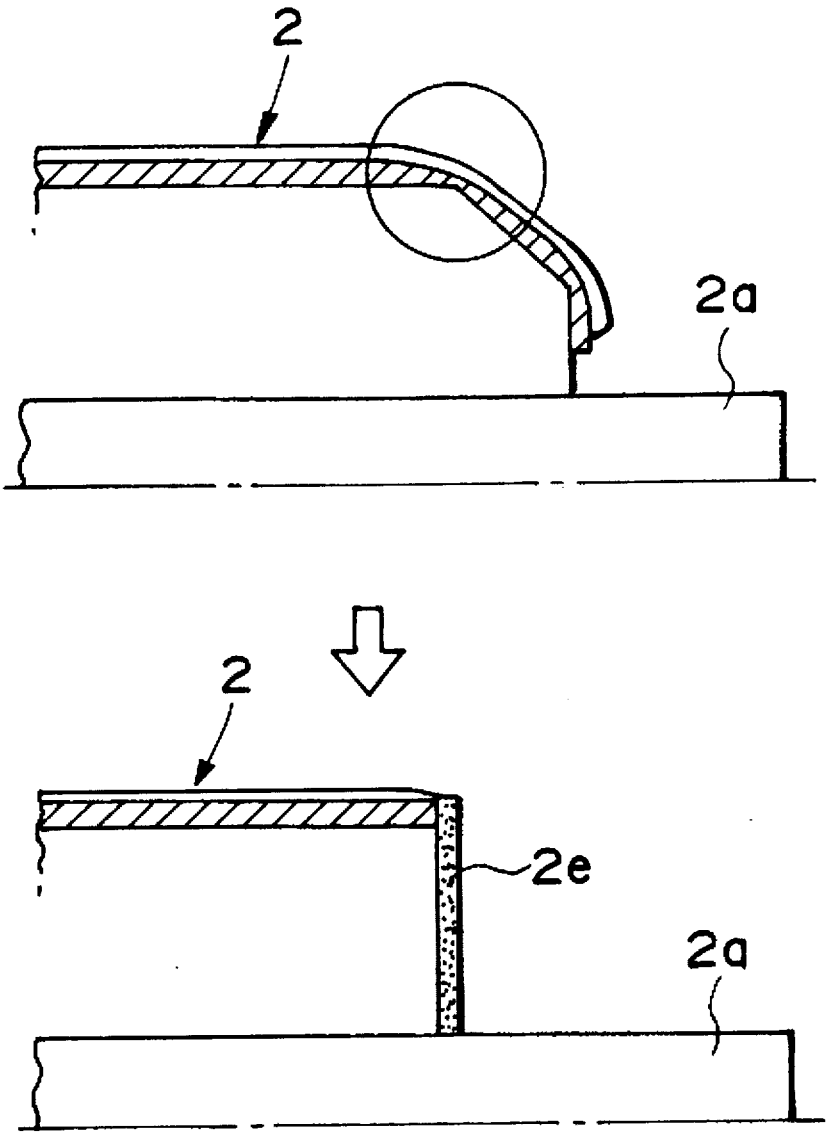
FIG. 2 is a schematic view of the longitudinal end of the charging roller, and also illustrates a charging roller reconditioning method in accordance with the present invention.

Therefore, it is preferable that the chamfered portions at the longitudinal ends of a used charging roller are removed before the used charging roller is recycled; the portions to the right of a broken line M in FIG. 1 are removed. In this case, the broken line M should be located slightly to the inward of the chamfer, but outside the image forming range of the photosensitive member in an image forming apparatus employing a charging roller.

With the removal of the chamfered portions, the new end surface becomes perpendicular to the generatrix, and resistance control layer 2*c* and surface protection layer 2*d* are exposed at the new surface. Therefore, it is preferable that the second resistive layer 2*e* is formed at the edge of the new longitudinal end, which is formed as the chamfered portion is removed, so that the current path is not established through the pin holes or shaved portions of the photosensitive drum 1. In this case, it is preferable that the volumetric resistivity value of the second resistive layer 2*e* is set higher than that of the resistance control layer 2*c*.

As for specific materials for the second resistive layer 2*e*, it is possible to employ synthetic resins such as urethane resin, epoxy resin, fluororesin, and the like, or synthetic rubbers such as NBR, CR, silicon rubber and the like. The second resistive layer 2*e* may be formed by coating a solution containing the resin, or may be formed of a film sheet of the aforementioned resin or rubber, which is glued to the end portion of the newly formed end portion of the charging roller 2. In this case, it is crucial that the external diameter of the second resistive layer 2*e* does not become larger than that of the pre-reconditioning charging roller 2. In other words, it is crucial that the second resistive layer 2*e* does not protrude above the original peripheral surface of the charging roller 2. The reason for this is that when the second resistive layer 2*e* protrudes above the original peripheral surface of the charging roller 2, the photosensitive drum 1 is liable to be damaged by the stepped portion of the newly formed peripheral surface of the charging roller 2.

Hereinafter, preferable embodiments of the charging roller reconditioning method in accordance with the present invention will be described with reference to a comparative example.

EMBODIMENT 1

The charging roller 2 was produced using the following specification.

| | |
|---|---|
| SBR | 100 wt. parts |
| Electrically conductive carbon black | 30 wt. parts |
| Zinc oxide | 5 wt. parts |
| Fatty acid | 2 wt. parts |

After the above materials were mixed and kneaded for 10 minutes in a sealed type kneading machine, the temperature of which was adjusted to 60° C., naphthenic oil was added by 20 wt parts relative to 100 wt parts of the SBR, to adjust the material compound, and thereafter, the mixture was kneaded for 20 minutes in the sealed type kneading machine, which had been cooled to 20° C. Next, 0.5 wt part of sulfur as a vulcanizing agent, 1.0 wt part of thiazole compound as a vulcanization accelerator, and 1.0 wt part of thiuram compound also as a vulcanization accelerator, relative to 100 wt parts of the material rubber SBR, were added, and the mixture was kneaded for 10 minutes using a two-roller machine, which had been cooled to 20° C.

Next, the obtained compound was formed, using transfer molding, into the electrically conductive elastic layer 2*b*, which covered the peripheral surface of a stainless steel core 2*a* with an external diameter of 6 mm, increasing the overall external diameter of the roller to 12 mm. During this process, both longitudinal ends of the charging roller 2 were chamfered to give them a 1.5 mm wide chamfer. Then, the charging roller 2 was cured at 145° C. for 30 minutes.

Next, the resistance control layer 2*c* was formed in the following manner, on the charging roller 2 obtained through the steps described above.

| | |
|---|---|
| Polyester polyol | 100 wt. parts |
| Methyl isobutyl ketone | 100 wt. parts |
| Electrically conductive carbon black | 10 wt. parts |
| Polyisocyanate | 6 wt. parts |

The surface of the electrically conductive elastic layer 2*b* was coated twice with the solution in which the above material was dispersed, using dip coating, and then, the solvent was evaporated by heating it for 30 minutes at 120° C. (thickness of the resistance control layer 2*c* after drying: 60 μm).

Thereafter, the surface protection layer 2*d* was formed in the following manner.

| | |
|---|---|
| N-methoxymethyl nylon | 100 wt. parts |
| Electrically conductive carbon black | 3 wt. parts |
| Methanol | 375 wt. parts |
| Toluene | 125 wt. parts |

The surface of the resistance control layer 2*c* of the charging roller 2 was coated once, using dip coating, with the solution, in which the above materials were dispersed, and then, the charging roller 2 was heated for 30 minutes at 100° C. to evaporate the solvent (thickness of the surface protection layer 2*d* after drying: 20 μm).

The resistance value of the charging roller 2 produced through the above steps was measured in an environment in which the temperature was 23° C. and the humidity was 55% RH. More specifically, the peripheral surface of the charging roller 2 was wrapped with aluminum foil (50 μm thick and 10 mm wide), and a DC voltage of 250 V was applied between the metallic core 2*a* and the aluminum foil to measure the resistance value using a resistance meter (ohmmeter) (HIOKI 3119 DIGITAL MΩ Hi TESTER: product of HIOKI DENKI). Measurement was taken at three points in the longitudinal direction of the charging roller 2 (both ends and center). The average value of the three measurements was 0.6 MΩ.

This charging roller 2 was assembled into a process cartridge (commercial name: EP-E cartridge, product of Canon) for a laser beam printer (commercial name: LBP-8 mark IV, product of Canon), to test it for durability; 8,000 transfer sheets were fed in an environment in which the temperature and humidity were 23° C. and 55%, respectively.

After the endurance test, the charging roller 2 was removed from the cartridge, and its surface was inspected using an optical microscope after the developer powder (toner) adhering to the surface was wiped away with methylethyl ketone. As a result, approximately 0.5 mm long cracks were found on the chamfer surfaces at both longitudinal ends of the charging roller 2.

Both of the chamfered end portions of the charging roller 2 were squarely cut away at a severing line (broken line designated by M), which is 2 mm from the original longitudinal end of the charging roller 2, as shown in FIG. 1.

Next, a 50 μm thick electrically insulating film of polytetrafluoroethylene (PTFE) (volumetric resistance value: $5\times10^{14}\Omega\cdot$cm) coated with adhesive was pasted to the new longitudinal end portions formed as the result of removing the chamfered portions, ending the reconditioning process for the used charging roller. Consequently, a reconditioned charging roller (1) was obtained.

Then, the above reconditioned charging roller (1) was assembled into the aforementioned process cartridge, which had never been used, to test it for durability in an environment in which the temperature was 23° C. and the humidity was 55%. During the test, 8,000 copies were made, but no image deterioration related to the reconditioned charging roller (1) occurred. Consequently, images of good quality could be produced.

EMBODIMENT 2

A charging roller 2 with the same structure as the first embodiment was produced, and was subjected to an endurance test with the same conditions as the first embodiment (temperature: 23° C.; humidity: 55%; number of transfer sheets: 8,000).

After the endurance test, the charging roller 2 was removed from the cartridge, and the developer powder (toner) adhering to the surface was wiped away with methylethyl ketone. Then, the surface of the charging roller 2 was inspected using an optical microscope. As a result, traces of wear were found at the edges of the chamfer at both longitudinal ends of the charging roller 2.

Next, both of the chamfered end portions of the charging roller 2 were squarely cut away at a severing line (broken line designated by M), which is 2 mm from the original longitudinal end of the charging roller 2, as shown in FIG. 1.

Then, a 30 μm thick epoxy resin paint was coated as the second resistive layer 2*e* (volumetric resistance value: $2\times10^{13}\Omega\cdot$cm) on the new longitudinal end portions formed as the result of removing the chamfered portions, ending the reconditioning process for the used charging roller. Consequently, a reconditioned charging roller (2) is obtained.

The reconditioned charging roller (2) was assembled into the aforementioned process cartridge, which had never been used, to test it for durability in an environment in which the temperature was 23° C. and the humidity was 55%. During the test, 8,000 copies were made, but no image deterioration originated from the reconditioned charging roller (2) occurred, and as a result, images of good quality could be produced.

EMBODIMENT 3

A charging roller 2 with the same structure as the first embodiment was produced, end was subjected to an endurance test with the same conditions as the first embodiment (temperature: 23° C.; humidify: 55%; number of transfer sheets: 8,000).

After the endurance test, the charging roller 2 was removed from the cartridge, and the developer powder (toner) adhering to the surface of the charging roller 2 was wiped away using methylethyl ketone. Then, the surface of the charging roller 2 was inspected using an optical microscope. As a result, traces of wear were found on the edges of the chamfers at both longitudinal ends of the charging roller 2.

Next, both of the chamfered end portions of the charging roller 2 were squarely cut away at a severing line (broken line designated by M), which is 2 mm from the original longitudinal end of the charging roller 2, as shown in FIG. 1.

Then, a 200 μm thick sheet of acrylonitrile-butadiene rubber (NBR) coated with adhesive was pasted as the second resistive layer 2*e* (volumetric resistance value: $2\times10^{13}\Omega\cdot$cm) to the new longitudinal end portions formed as the result of removing the chamfered portions, to yield a reconditioned charging roller (3).

The reconditioned charging roller (3) was assembled into the aforementioned process cartridge, which had never been used, to test it for durability in an environment in which the temperature was 23° C. and the humidity was 55%. During the test, 8,000 copies were made, but no image deterioration originated from the reconditioned charging roller (2) occurred, and as a result, images of good quality could be produced.

COMPARATIVE EXAMPLE

A charging roller 2 with the same structure as the first embodiment was produced, and was subjected to an endurance test with the same conditions as the first embodiment (temperature: 23° C.; humidity: 55%; number of transfer sheets: 8,000).

After the endurance test, the charging roller 2 was removed from the cartridge, and the developer powder (toner) adhering to the surface of the charging roller 2 was wiped away using methylethyl ketone. Then, the surface of the charging roller 2 was inspected using an optical microscope. As a result, traces of wear were found on the edges of the chamfers at both longitudinal ends of the charging roller 2.

Then, the cleaned charging roller 2 was assembled into the aforementioned process cartridge, which had never been used, to test it for durability in an environment in which the temperature was 23° C. and the humidity was 55%. During the test, image deterioration (horizontal black stripes) occurred after 5000 copies, due to the current leak (dielectric breakdown) which occurred at the end portions of the charging roller 2.

In the first to fourth embodiments, the longitudinal end portions of the coat layers of the charging roller were chamfered before reconditioning, but they may be round instead. It should be noted here that the chamfering or rounding of the longitudinal end portions is not mandatory.

While the invention has been described with reference to the structures disclosed herein, it is not confined to the details set forth, and this application is intended to cover such modifications or changes as may come within the purposes of the improvements or the scope of the following claims.

What is claimed is:

1. A reconditioning method for a used charging roller, wherein said charging roller comprises a core member and a coating layer thereon, said coating layer including an electroconductive layer and a first resistance layer covering a peripheral surface layer and end surface layer, said method comprising the steps of:

removing an end portion of the coating layer; and coating the removed end portion with a second resistance layer.

2. A method according to claim 1, wherein said second resistance layer is either one of resin and rubber material.

3. A method according to claim 1, wherein the end of said charging roller before said removing step is provided with a chamfered portion.

4. A method according to claim 1, wherein an outer diameter of the second resistance layer is not more than an outer diameter of said coating layer.

5. A method according to claim 1, wherein said second resistance layer has a volume resistivity larger than that of said first resistance layer.

6. A method according to claim 1, wherein said charging roller is used for charging an electrophotographic photosensitive member, and is contacted to the electrophotographic photosensitive member.

7. A method according to claim 6, wherein said charging roller is contained in a process cartridge detachably mountable to an electrophotographic apparatus, and said process cartridge contains the photosensitive member.

8. A reconditioning method for a used charging roller, wherein said charging roller comprises a core member and a coating layer thereon, said coating layer being provided with a chamfered portion, said method comprising the steps of:

removing an end portion of the coating layer;

coating the removed end portion with a resistance layer.

9. A method according to claim 8, wherein said second resistance layer is either one of resin and rubber material.

10. A method according to claim 8, wherein an outer diameter of the resistance layer is not more than an outer diameter of said coating layer.

11. A method according to claim 8, wherein said charging roller is used for charging an electrophotographic photosensitive member, and is contacted to the electrophotograhic photosensitive member.

12. A method according to claim 11, wherein said charging roller is contained in a process cartridge detachably mountable to an electrophotographic apparatus, and said process cartridge contains the photosensitive member.

* * * * *

UNITED STATES PATENT AND TRADEMARK OFFICE

CERTIFICATE OF CORRECTION

PATENT NO. : 5,678,140

DATED : October 14, 1997

INVENTOR(S) : FUEI, ET AL.

It is certified that error appears in the above-indentified patent and that said Letters Patent is hereby corrected as shown below: On title page,

At [56] References Cited

After "5,381,213 1/1995 Michlin 399/109" insert

-- FOREIGN PATENT DOCUMENTS

| | | |
|---|---|---|
| 0 541 375 A2 | 05/1993 | European |
| 0 622 704 A2 | 11/1994 | European |
| 63-208877 | 08/1988 | Japan |
| 7-043984 | 02/1995 | Japan |
| 7-104557 | 04/1995 | Japan |
| 7-160155 | 06/1995 | Japan |

OTHER PUBLICATIONS

Patent Abstracts of Japan, Vol. 12, No. 499 (P-807), December 27, 1988, pertaining to JP 63-208877, published August 30, 1988.

Patent Abstracts of Japan, Vol. 95, No. 005, June 30, 1995, pertaining to JP 7-043984, published February 14, 1995.

UNITED STATES PATENT AND TRADEMARK OFFICE

CERTIFICATE OF CORRECTION

PATENT NO. : 5,678,140

DATED : October 14, 1997

INVENTOR(S) : FUEI, ET AL.

It is certified that error appears in the above-identified patent and that said Letters Patent is hereby corrected as shown below:

Patent Abstracts of Japan, Vol. 95, No. 007, August 31, 1995, pertaining to JP 7-104557, published April 21, 1995.

Patent Abstracts of Japan, Vol. 95, No. 006, pertaining to JP 7-160155, published June 23, 1995.--.

Column 3

Line 57, change "is gradually increases" to --gradually increases--.

Column 4

Line 11, "elastomar" should read --elastomer--; and
Line 65, "chamfered" should read --chamfered at--.

Column 8

Line 17, "end" should read --and--; and
Line 19, "humidify" should read --humidity--.

UNITED STATES PATENT AND TRADEMARK OFFICE

CERTIFICATE OF CORRECTION

PATENT NO. : 5,678,140

DATED : October 14, 1997

INVENTOR(S) : FUEI, ET AL.

It is certified that error appears in the above-indentified patent and that said Letters Patent is hereby corrected as shown below:

Column 8

Line 17, "end" should read --and--; and
Line 19, "humidify" should read --humidity--.

Signed and Sealed this

Sixteenth Day of June, 1998

*Attest:*

*Attesting Officer*

Bruce Lehman

BRUCE LEHMAN

*Commissioner of Patents and Trademarks*